United States Patent [19]

Beckmann et al.

[11] 4,251,110

[45] Feb. 17, 1981

[54] MINERAL MINING INSTALLATION

[75] Inventors: Klaus Beckmann, Lünen; Hans-Theodor Grisebach, Unna, both of Fed. Rep. of Germany

[73] Assignee: Gewerkschaft Eisenhütte Westfalia, Lüen, Fed. Rep. of Germany

[21] Appl. No.: 967,458

[22] Filed: Dec. 7, 1978

[30] Foreign Application Priority Data

Dec. 7, 1977 [DE] Fed. Rep. of Germany ..... 2754381

[51] Int. Cl.[3] ..... E21C 25/60

[52] U.S. Cl. ..... 299/17; 299/34; 299/43

[58] Field of Search ..... 299/81, 43, 42, 34, 299/17

[56] References Cited

U.S. PATENT DOCUMENTS

| | | | |
|---|---|---|---|
| 3,356,417 | 12/1967 | Heyer et al. | 299/34 |
| 4,049,318 | 9/1977 | Fruin | 299/18 |
| 4,067,257 | 1/1978 | Pentith | 299/43 |
| 4,072,355 | 2/1978 | Pentith | 299/43 |
| 4,111,489 | 9/1978 | Beckman | 299/34 |

FOREIGN PATENT DOCUMENTS

| | | | |
|---|---|---|---|
| 672334 | 1/1950 | United Kingdom | 299/17 |

*Primary Examiner*—William F. Pate, III

*Attorney, Agent, or Firm*—Sughrue, Rothwell, Mion, Zinn and Macpeak

[57] ABSTRACT

A mineral mining installation comprises a mechanical mining machine (such as a plough or a shearer) and a hydraulic winning machine. The hydraulic winning machine has a plurality of high-pressure nozzles and a high-pressure pump for supplying the nozzles with high-pressure water (or other hydraulic fluid). Means are provided for driving each of the two winning machines independently of the other along a mineral face. This permits the mechanical winning machine to operate at its optimum, high speed rate without interference from the slower moving hydraulic winning machine. The pump is preferably a multiple radial-piston pump powered by an electric motor. Both electric power and water may be supplied to the hydraulic winning machine via pick-up arms on the machine and supply channels extending along the face.

23 Claims, 7 Drawing Figures

MINERAL MINING INSTALLATION

BACKGROUND TO THE INVENTION

This invention relates to a mineral mining installation, and in particular to an installation for winning material such as coal.

In place of conventional winning machines such as coal ploughs or shearers (which win coal mechanically), it is known to use machines which win coal by hydraulic pressure. Typically, such a machine has a plurality of nozzles which are fed with hydraulic fluid under a high pressure of 400 to 1,000 bars or even higher. Usually, the hydraulic fluid is water, though other fluids could also be used. One known hydraulic winning machine has a drum provided with high-pressure nozzles on its circumference, and another has a plough body provided with high-pressure nozzles in place of plough cutter bits (see DT-OS No. 2548951 and DT-OS No. 2307413). It is also known to provide a plough body with high-pressure nozzles as well as cutter bits (see GB-PS No. 672,336). In this case the plough body is provided with a high-pressure pump which raises the pressure of hydraulic fluid from that of the supply to that necessary for the hydraulic winning work.

Unfortunately, the known types of hydraulic winning machines suffer from difficulties which have prevented them from becoming established as practical devices. In particular, such machines require a very large input of water, and difficulties arise in the production and feed of high-pressure water to the nozzles of a high-speed winning machine.

The aim of the invention is to provide a winning machine which utilises the hydraulic winning method but does not suffer from these disadvantages.

SUMMARY OF THE INVENTION

The present invention provides a mineral mining installation comprising a mechanical winning machine and a hydraulic winning machine, the hydraulic winning machine having a plurality of high-pressure nozzles and a high-pressure pump for supplying the nozzles with high-pressure hydraulic fluid, wherein means are provided for moving each winning machine independently of the other along a mineral face. Preferably, each winning machine is provided with independent drive means.

With this installation, it is possible to carry out combined mechanical and hydraulic winning using separate mechanical and hydraulic winning machines. The mechanical winning machine will usually carry out the main winning work in the conventional manner, whilst the hydraulic winning machine fulfils an auxiliary winning function. For example, the hydraulic winning machine can be used to cleave or loosen mineral from the face, to win mineral from the upper or lower regions only of the face, or to win material in faulty seam zones of the face. In all these cases, the winning work of the mechanical winning machine (usually a high speed plough or shearer) is facilitated and the output is increased even under difficult working conditions. The main reason for this is that the mechanical winning machine can move along the face at its normal speed without interference from the slower moving hydraulic winning machine. In this case, it is preferable for each winning machine to be drivable along a respective guide extending, in use, along the mineral face, the two guides being so positioned that the two winning machines can be driven past one another. Where it is not essential for the two winning machines to pass one another, they may be drivable along a common guide extending, in use, along the mineral face.

Advantageously, detachable coupling means are provided for coupling the two winning machines together for conjoint movement along the mineral face. This coupling of the two winning machines is useful, particularly when the hydraulic winning machine is being used to win mineral material in a faulty seam zone. In this case, the winning work is usually effected solely by the mechanical winning machine, the hydraulic winning machine only being brought into operation when needed.

Preferably, the mechanical winning machine is also provided with high-pressure nozzles for supplying said nozzles with high-pressure hydraulic fluid from the pump of the hydraulic winning machine. In this case, the pump may be arranged to supply only the nozzles on the mechanical winning machine.

The hydraulic winning machine may be provided with an electric motor for driving the pump. Advantageously, the pump is a multiple radial-piston pump, and preferably, the pump is capable of delivering hydraulic fluid at different pressures. In this case, the pump may supply hydraulic fluid to the nozzles of the hydraulic winning machine at a first pressure, and to the nozzles of the mechanical winning machine at a second pressure lower than said first pressure. Preferably, said first pressure lies in the range of from 2,000 to 4,000 bars and said second pressure lies in the range of from 1,000 to 2,000 bars.

Advantageously, the installation further comprises means for loading won mineral material onto a conveyor which extends along the mineral face. Preferably, the mechanical winning machine and/or the hydraulic winning machine is provided with said loading means.

The hydraulic winning machine may be provided with a current pick-up arm which, in use, picks up electric current from a conductor housed in a conduit extending along the mineral face, the pick-up arm entering the conduit through a slot extending therealong. Advantageously, the conduit is provided with elastic seals for covering said slot, the pick-up arm extending through the elastic seals, and the conduit is filled with a pressurized gas such as compressed air or nitrogen enriched compressed air. This reduces the risk of underground explosions arising from methane entering the conduit.

Advantageously, the hydraulic winning machine is provided with a collector arm which, in use, picks up hydraulic fluid from a channel extending along the mineral face, the collector arm entering the channel through a slot extending therealong. Preferably, the channel is provided with elastic seals for covering said slot.

The invention also provides a hydraulic winning machine for use in a mineral mining installation as defined above, the hydraulic winning machine being movable, in use, along the mineral face to be won, and having a plurality of high-pressure nozzles, a multiple radial-piston pump for supplying the nozzles with high-pressure hydraulic fluid, and an electric motor for driving the pump, wherein the hydraulic winning machine is provided with a current pick-up arm which, in use, picks up electric current from a conductor housed in a conduit extending along the mineral face, the pick-up arm entering the conduit through a slot extending therealong, and wherein the hydraulic winning machine is provided with a collector arm which, in use, picks up hydraulic fluid from a channel extending along the mineral face, the collector arm entering the channel through a slot extending therealong.

The invention further comprises mineral winning apparatus which, in use, extends along a mineral face to be won, a guide provided on the face side of the conveyor, and a hydraulic winning machine movable along the guide, the hydraulic winning machine being as defined above. Advantageously, the electrical supply conduit and the hydraulic fluid supply channel are arranged, in use, on the goaf side of the conveyor, the hydraulic winning machine being provided with a portal arm which extends over the conveyor and which carriers the pick-up arm and the collector arm. Preferably, the pump is provided at the goaf side of the portal arm.

The advantage of using a multiple radial-piston pump is that such a pump has relatively small external dimensions but can generate high pressures of the order of 4,000 bars. Moreover, by arranging for this pump to operate in different pressure ranges, the apparatus can readily be adapted to winning mineral materials of different hardness. For example, rock may require pressures of 2,000 to 4,000 bars, whereas coal can be won with lower pressures. The feed system constituted by the electrical supply conduit and the hydraulic fluid (usually water) supply channel enables the hydraulic winning machine to operate safely even at high working speeds.

BRIEF DESCRIPTION OF DRAWINGS

Several forms of mineral mining installations, each constructed in accordance with the invention, will now be described, by way of example, with reference to the accompanying drawings, in which.

DESCRIPTION OF PREFERRED EMBODIMENT

Figure 1:
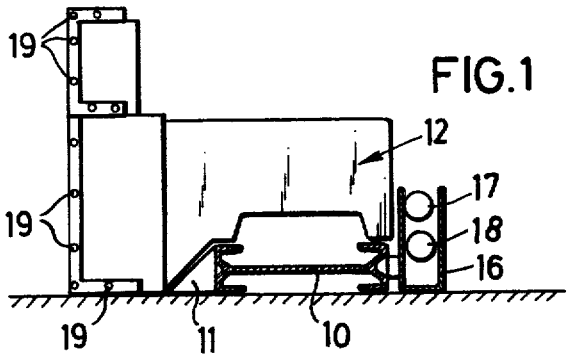
FIG. 1 is a part-sectional end elevation of a hydraulic winning machine forming part of a first form of installation.
Figure 2:
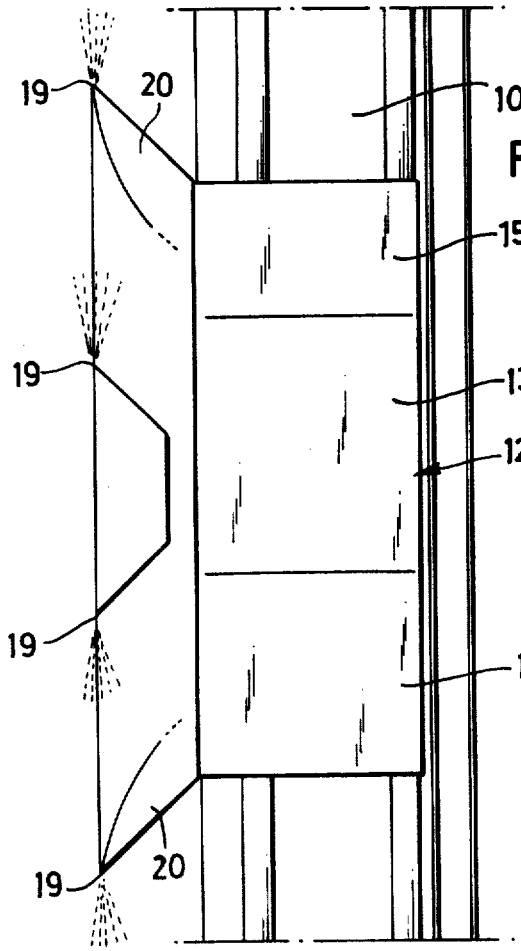
FIG. 2 is a plan view of the machine of FIG. 1.

Referring to the drawings, FIGS. 1 and 2 show a scraper chain conveyor 10 provided with a ramp-like guide 11 on the coal face side thereof. A hydraulic winning machine 12 is guided for movement along the conveyor 10. The hydraulic winning machine 12 has an electric motor 13, a high-pressure pump 14 and a pressurised water vessel 15, all arranged within the outer casing of the hydraulic winning machine. A protective channel 16 is provided on the goaf side of the conveyor 10, the channel housing a hose 17 for supplying low-pressure water to the vessel 15, and a supply cable 18 leading to the electric motor 13. The electric motor 13 is provided to drive the pump 14. The hydraulic winning machine 12 can be driven too and fro along the conveyor by means of a conventional chain drive system, a rack-and-pinion drive or any other known type of drive arrangement.

The hydraulic winning machine 12 is effectively constituted by a plough body provided with a plurality of high-pressure nozzles 19 which are arranged in columns, each column having several nozzles arranged one above another. Each of the nozzles 19 is mounted for vertical displacement and/or for lateral pivoting. During the winning work, the hydraulic winning machine moves along the coal face, the high-pressure water jets issuing from the nozzles 19 serving to cut away coal from the face. Won coal is loaded onto the conveyor 10 by means of inclined loading surfaces 20 which direct such loose coal over the guide 11 and onto the conveyor.

The hydraulic winning machine 12 is used in conjunction with any standard mechanical coal-winning plough (not shown in FIGS. 1 and 2), which is also reciprocable along the guide 11 provided on the coal face side of the conveyor 10. In this case, the hydraulic winning machine 12 need only be used where this is necessary for example in faulty seam zones. It can also be used, however, to win coal along the entire length of the face, for example from upper portions of the seams. It can also be used to remove pockets of waste or to loosen the seam in order to facilitate the winning action of the mechanical plough. In other words, the hydraulic winning machine 12 is used merely as an auxiliary winning machine and so its use does not lead to excessive use of high-pressure water.

The installation shown in FIGS. 3 and 4 again has a conveyor 10, a guide 11 and a hydraulic winning machine 12. These figures also show, however, a mechanical coal-winning plough 23 which is provided with a plurality of cutters bits 23A and a plurality of high-pressure nozzles 23B. This plough 23 would be used with the hydraulic winning machine of FIGS. 1 and 2. The plough 23 is driven in known manner by means of an endless plough drive chain, the return run 21 of which is guided in an upper channel beneath the guide 11, and the traction run 22 of which is guided in a lower channel also situated beneath the guide 11. The hydraulic winning machine 12 is guided for movement along the coal face by means of guide rails 24 and 25 which are positioned above the guide 11, the guide rail 24 being situated at the face side of the conveyor 10, and the guide rail 25 being situated at the goaf side.

Figure 3:
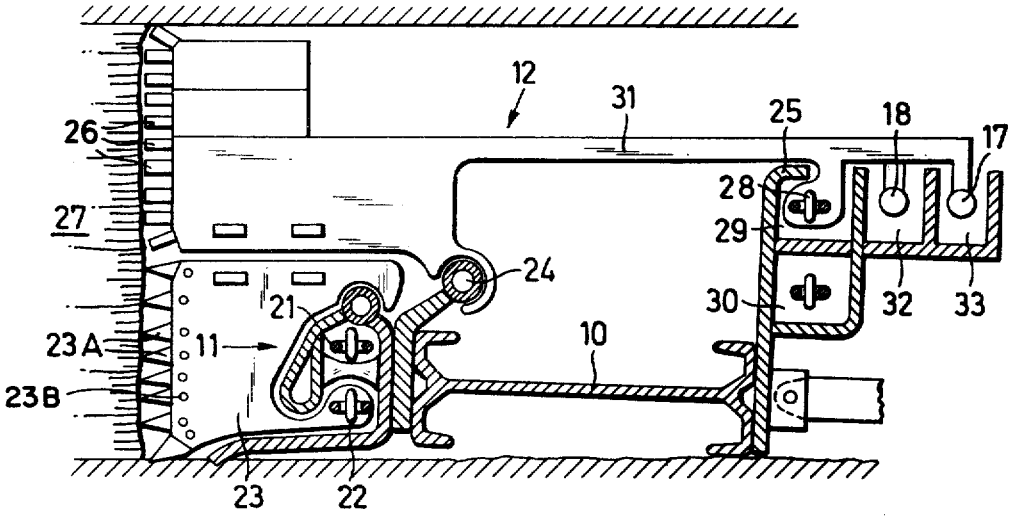
FIG. 3 is a part-sectional end elevation of a second form of installation, and showing a hydraulic winning machine and a mechanical plough.
Figure 4:
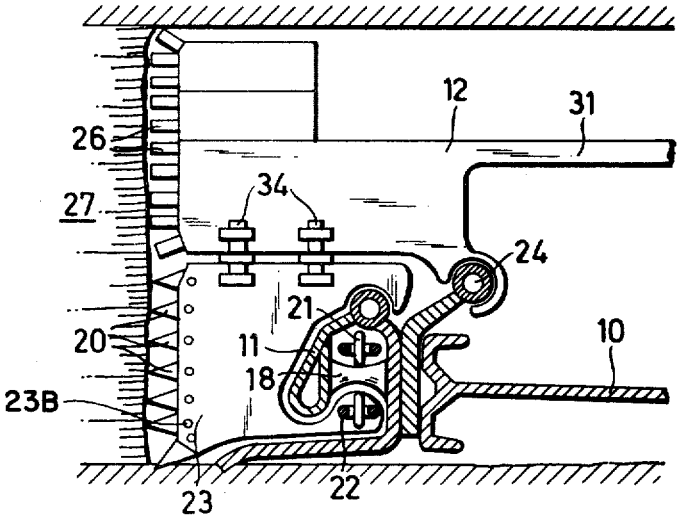
FIG. 4 is a part-sectional end elevation of part of the second form of installation and showing the hydraulic winning machine coupled to the mechanical plough.

The hydraulic winning machine 12 of FIGS. 3 and 4 is basically the same as that of FIGS. 1 and 2, and is provided with an electric motor, a high-pressure pump and a pressurised water vessel (none of which are shown in FIGS. 3 and 4 for reasons of clarity). The hydraulic winning machine 12 is also provided with high-pressure nozzles 26 which are arranged in echelon formation so as to cut away the upper portion of the seam 27 being won, the plough 23 serving to win coal in the lower seam region.

The hydraulic winning machine 12 is movable along the face 27 independently of the plough 23. This enables the plough 23 to be driven at a relatively fast speed and the hydraulic winning machine 12 at a relatively low speed. Both machines can, therefore, be operated under optimum working conditions. In the embodiment of FIGS. 3 and 4, the hydraulic winning machine 12 is driven by means of an endless chain 20 which is guided in channels 29 and 30 arranged on the goaf side of the conveyor 10. The hydraulic winning machine 12 is provided with a portal arm 31 which extends over the conveyor and is coupled to the traction run of the chain 28 in the upper channel 29. Adjacent to the channels 29 and 30 on the goaf side of the conveyor 10, are channels 32 and 33 housing respectively the electric cable 18 and the supply hose 17. In the embodiment of FIG. 3, the plough 23 can run through beneath the hydraulic winning machine 12, the plough doing the main winning work and the hydraulic winning machine fulfilling an auxiliary winning function in the upper zone of the seam. The won material is loaded onto the conveyor 10, however, solely by the plough 23.

It is also possible to couple the hydraulic winning machine 12 and the plough 23, this coupling being effected by means of coupling elements 34 (see FIG. 4). In this case, the combined unit can be moved along the face by the plough drive system and/or the drive system for the hydraulic winning machine 12. The high-pressure nozzles 23B of the plough 23 are fed with water under high pressure from the hydraulic winning machine. Preferably, the coupling elements 34 are arranged to be of the quick-release variety.

It will be apparent that the hydraulic winning machine 12 of the embodiment of FIGS. 3 and 4 could be arranged to win coal from the base of the seam 27 rather than the top. The hydraulic winning machine could also be used as a stable-hole plough.

Figure 5:
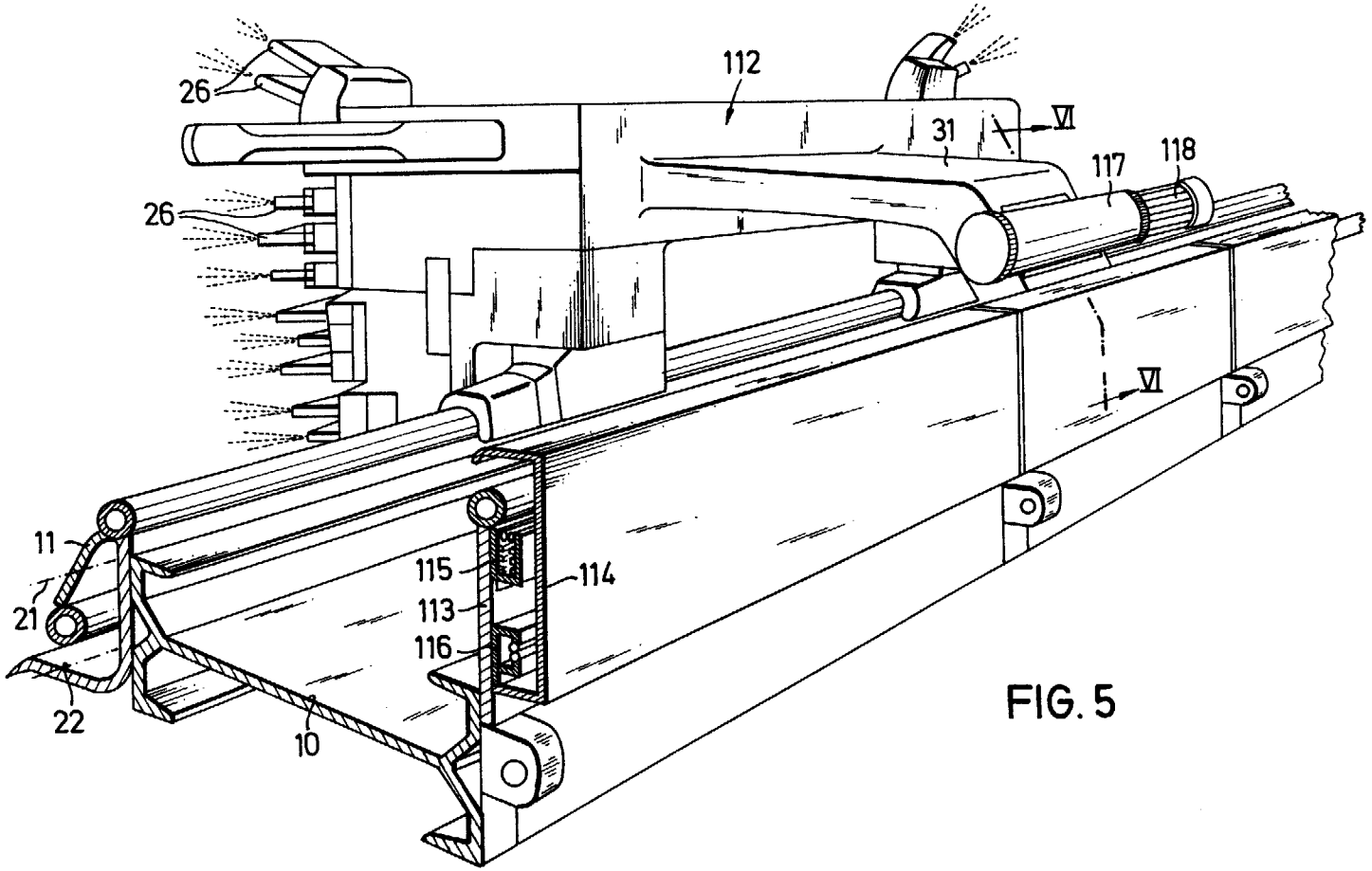
FIG. 5 is a perspective view of a third form of installation.

FIG. 5 shows a hydraulic winning machine 112 which can be used in place of the hydraulic winning machine 12 of the embodiments of FIGS. 1 to 4. This machine 112 could also be used without a conventional mechanical winning machine such as a plough or a shearer. The body 100 of the hydraulic winning machine 112 is guided on a guide 11 provided at the face side of a conveyor 10, a portal arm 31 extending over the conveyor for guidance by a guide rail 25 on the goaf side thereof. The goaf side of the conveyor 10 is also provided with upwardly extending guard plates 113 and with cover plates 114 connected to the guard plates. These plates 113 and 114 define upper and lower channels 115 and 116. The upper channel 115 serves as an electrical supply to the pump drive system (to be described below) of the hydraulic winning machine 112, and the lower channel 116 is a water supply channel. A high-pressure multiple radial-piston pump 117 is provided at the goaf side of the portal arm 31, the pump receiving electric current and water from the channels 115 and 116. The pistons of the pump 117 each have a diameter which is relatively small (10 mm. at the most). The pump 117 provides high-pressure water to a plurality of nozzles 26 provided at the face-side of the hydraulic winning machine 112. The nozzles 26 may be formed in plough cutter bits so that the machine 112 also wins coal mechanically as well as hydraulically. Such cutter bits are fitted with hard metal tips.

Figure 6:
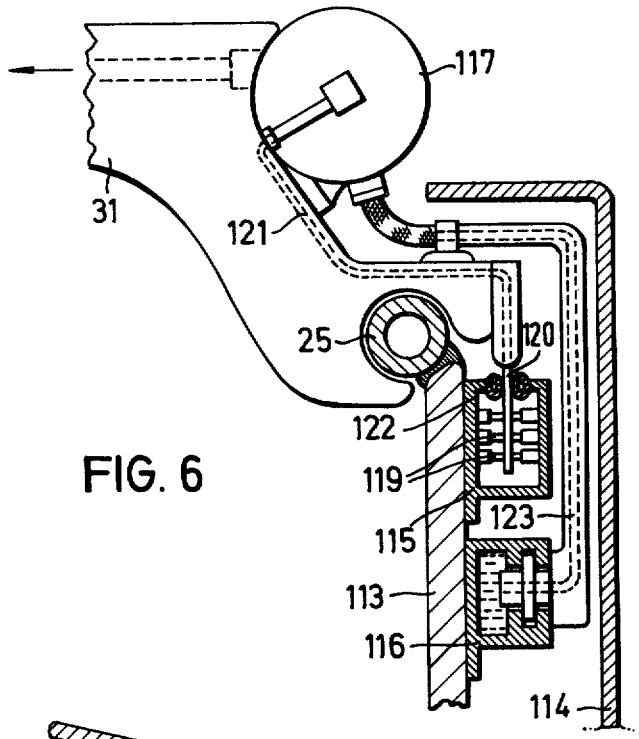
FIG. 6 is a part-sectional end elevation of part of the installation of FIG. 5.

As best seen in FIG. 6, electrical conductor rails 119 are arranged in the channel 115. A current pick-up arm 120 is provided on the portal arm 31, the pick-up arm entering the channel 115 from above and being in sliding contact with the rails 119. The pick-up arm 120 is connected to a motor 118 driving the pump 117 via a cable 121. The upper side of the channel 115 is closed by means of elastic seals 122, through which the pick-up arm 120 extends to make contact with the rails 119. In order to reduce the dangers of explosions, the channel 115 is supplied with a pressurised gas (compressed air and/or nitrogen) so that methane enriched air cannot penetrate the channel from the exterior.

The water-supply channel 16 is provided with a side-opening through which a collector arm 123 extends, the collector arm serving to draw low pressure water from the channel 116 and deliver it to the pump 117. The delivery side of the pump 117 is connected to the high-pressure nozzles 26 via high-pressure conduits provided within the portal arm 31 and the body 100. Thus, there is no need for flexible water supply hoses. As with the current supply channel 115, the water-supply channel 116 is closed by means of elastic seals (not shown) through which the collector arm 123 extends.

The radial-piston pump 117 may be arranged to deliver water at different working pressures. In particular, the pump 117 may be arranged to deliver water at a first, very high pressure (say 2,000–4,000 bars) to the cutter nozzles 26, and to deliver water at a second, lower pressure (say 1,000–2,000 bars) to cutter nozzles (not shown) arranged on a plough (not shown but similar to the plough 23 of the embodiment of FIGS. 3 and 4). It is also possible to apply different working pressures to different sections of the nozzles 26.

Figure 7:
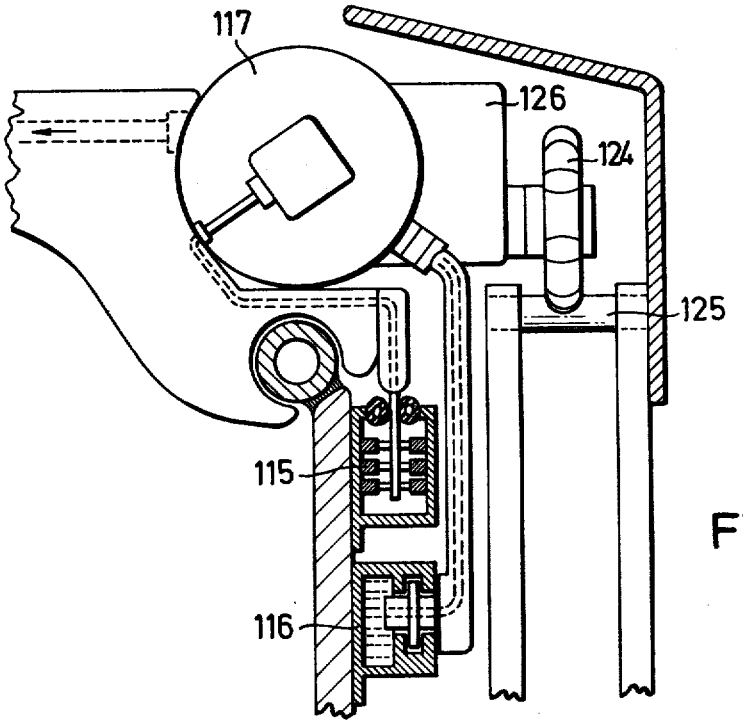
FIG. 7 is a view similar to that of FIG. 6 but showing a modified embodiment.

FIG. 7 shows a hydraulic winning machine 112 which is similar to that of FIGS. 5 and 6, but which is driven by a rack-and-pinion drive rather than by an endless chain drive. Thus, the winning machine 112 of FIG. 7 has an electrically driven pinion 124 which meshes with a rack 125 attached to the conveyor 10 on the goaf side. The motor (not shown) for driving the pinion 124 is mounted on the goaf side of the portal arm 31, and is fed by a pick-up arm (not shown but similar to the arm 120) from the currentsupply channel 115.

It will be apparent that the installation described above could be modified in many ways. In particular the hydraulic winning machine 12 of the embodiments of FIGS. 1 to 4 could be supplied with water and electric current in the same manner as the machines 12 of FIGS. 5 to 7. Moreover, any other type of mechanical winning machines (such as a shearer) may be used in place of the plough 23.

We claim:

1. A mineral mining installation comprising a mechanical winning machine and a hydraulic winning machine, the hydraulic winning machine having a plurality of high-pressure nozzles and a high-pressure pump for supplying the nozzles with high-pressure hydraulic fluid, wherein means are provided for moving each winning machine independently of the other along a mineral face, and wherein detachable coupling means are provided for coupling the two winning machines together for conjoint movement along the mineral face, the mechanical winning machine having cutter bits for mechanical mineral winning and high-pressure nozzles for hydraulic mineral winning, means being provided for supplying said nozzles of the mechanical winning machine with high-pressure hydraulic fluid from the pump of the hydraulic winning machine when the two winning machines are coupled together.

2. An installation according to claim 1, wherein each winning machine is provided with independent drive means.

3. An installation according to claim 1, wherein each winning machine is drivable along a respective guide extending along the mineral face, the two guides being so positioned that the two winning machines can be driven past one another.

4. An installation according to claim 1, wherein the two winning machines are drivable along a common guide extending along the mineral face.

5. An installation according to claim 1, wherein the hydraulic winning machine is provided with an electric motor for driving the pump.

6. An installation according to claim 1, wherein the pump is capable of delivering hydraulic fluid at different pressures.

7. An installation according to claim 6, wherein the pump supplies hydraulic fluid to the nozzles of the hydraulic winning machine at a first pressure, and to the nozzles of the mechanical winning machine at a second pressure lower than said first pressure.

8. An installation according to claim 7, wherein said first pressure lies in the range of from 2,000 to 4,000 bars, and said second pressure lies in the range of from 1,000 to 2,000 bars.

9. An installation according to claim 1, further comprising means for loading won mineral material onto a conveyor which extends along the mineral face.

10. An installation accoding to claim 9, wherein the mechanical winning machine is provided with said loading means.

11. An installation according to claim 1, wherein the pump is a multiple radial-piston pump.

12. An installation according to claim 1, wherein the hydraulic winning machine is provided with a current pick-up arm which picks up electric current from a conductor housed in a conduit extending along the mineral face, the pick-up arm entering the conduit through a slot extending therealong.

13. An installation according to claim 12, wherein the conduit is provided with elastic seals for covering said slot, the pick-up arm extending through the elastic seals.

14. An installation according to claim 13, wherein the conduit is filled with a pressurised gas.

15. An installation according to claim 14, wherein the pressurised gas is compressed air.

16. An installation according to claim 14, wherein the pressurised gas is nitrogen enriched compressed air.

17. An installation according to claim 1, wherein the hydraulic winning machine is provided with a collector arm which picks up hydraulic fluid from a channel extending along the mineral face, the collector arm entering the channel through a slot extending therealong.

18. An installation according to claim 17, wherein the channel is provided with elastic seals for covering said slot.

19. An installation according to claim 1, wherein the hydraulic fluid is water.

20. In or for a mineral mining installation according to claim 1, a hydraulic winning machine which is movable along a mineral face to be won, the hydraulic winning machine having a plurality of high-pressure nozzles, a multiple radial-piston pump for supplying the nozzles with high-pressure hydraulic fluid, and an electric motor for driving the pump, wherein the hydraulic winning machine is provided with a current pick-up arm which picks up electric current from a conductor housed in a conduit extending along the mineral face, the pick-up arm entering the conduit through a slot extending therealong, and wherein the hydraulic winning machine is provided with a collector arm which picks up hydraulic fluid from a channel extending along the mineral face, the collector arm entering the channel through a slot extending therealong.

21. Mineral winning apparatus comprising a mechanical winning machine, a conveyor which extends along a mineral face to be won, a guide provided on the face side of the conveyor, and a hydraulic winning machine movable along the guide, the hydraulic winning machine having a plurality of high-pressure nozzles, a multiple radial-piston pump for supplying the nozzles with high-pressure hydraulic fluid, and an electric motor for driving the pump, wherein the hydraulic winning machine is provided with a current pick-up arm which picks up electric current from a conductor housed in a conduit extending along the mineral face, the pick-up arm entering the conduit through a slot extending therealong, and wherein the hydraulic winning machine is provided with a collector arm which picks up hydraulic fluid from a channel extending along the mineral face, the collector arm entering the channel through a slot extending therealong, and wherein detachable coupling means are provided for coupling the two winning machines together for conjoint movement along the mineral face, the mechanical winning machine having cutter bits for mechanical mineral winning and high-pressure nozzles for hydraulic mineral winning, means being provided for supplying said nozzles of the mechanical winning machine with high-pressure hydraulic fluid from the pump of the hydraulic winning machine when the two winning machines are coupled together.

22. Apparatus according to claim 21, wherein the electrical supply conduit and the hydraulic fluid supply channel are arranged on the goaf side of the conveyor, the hydraulic winning machine being provided with a portal arm which extends over the conveyor and which carries the pick-up arm and the collector arm.

23. Apparatus according to claim 22, wherein the pump is provided at the goaf side of the portal arm.

* * * * *